United States Patent [19]

Wilson

[11] 4,120,343

[45] Oct. 17, 1978

[54] DISPOSABLE SHOWER CURTAIN ENSEMBLE

[76] Inventor: Eunice D. Wilson, 2504 Tonoka Rd., Richmond, Va. 23223

[21] Appl. No.: 831,029

[22] Filed: Sep. 6, 1977

[51] Int. Cl.[2] ..... A47H 1/00; A47K 3/14

[52] U.S. Cl. ..... 160/330; 4/149; 4/153; 4/154; 160/388

[58] Field of Search ..... 160/330, 388, 389, 385, 160/349 R, 124; 4/154, 149, 153, DIG. 18

[56] References Cited

U.S. PATENT DOCUMENTS

| | | | |
|---|---|---|---|
| 2,831,538 | 4/1958 | Lishman | 160/330 |
| 3,321,003 | 5/1967 | Boerner | 160/330 X |
| 3,439,725 | 4/1969 | Haimovitz et al. | 160/388 X |
| 3,654,064 | 4/1972 | Laumann | 4/DIG. 18 UX |

*Primary Examiner*—Philip C. Kannan
*Attorney, Agent, or Firm*—Norman B. Rainer

[57] ABSTRACT

An inexpensive shower curtain ensemble is provided consisting of a curtain member and a plurality of flexible strap members. The curtain member is a flexible opaque rectangular sheet comprised of cellulosic paper having a basis weight between 50 and 400 grams per square meter, at least one surface of which being covered by an adherent layer of water-resistant organic polymer material. Adjacent its upper edge, the curtain member contains a uniformly spaced series of holes. The strap members have an elongated configuration terminating in anchor ends provided with contact-type adhesive means capable of rapidly establishing an adhesive bond with either surface of said curtain member.

1 Claim, 3 Drawing Figures

DISPOSABLE SHOWER CURTAIN ENSEMBLE

BACKGROUND OF THE INVENTION

This invention relates to improvements in shower curtains and is more particularly concerned with an inexpensively fabricated shower curtain comprised of a flexible composite sheet structure, and means for suspending said curtain from an overhead support.

Showers designed for bathing purposes generally consist of a spray head positioned at an elevated location within an enclosure capable of catching water and facilitating its drainage away from said enclosure. In stall-type and bathtub enclosures, it is common to utilize a horizontally traversable flexible curtain to facilitate passage into and out of the shower enclosure. The curtain, when deployed to its fully open state, serves to prevent water from traveling beyond the bounds of the enclosure, and is preferably opaque, so as to afford privacy to the user.

Because of its moist environment, and the accumulation of soap deposites, shower curtains frequently undergo deterioration of appearance. Although the curtain may still retain its functional properties, it may become unsightly and unsanitary. The restoration of the curtains to a clean condition is not always possible, and in any event, is a troublesome chore.

The use of inexpensive shower curtains which may be feasibly discarded after relatively little use has been disclosed in U.S. Pat. Nos. 2,613,368, 3,000,016 and 3,836,416, and elsewhere. However, such earlier disclosed shower curtains have generally been deficient in functional performance and aesthetic characteristics. If, for example, the curtain is inexpensively fabricated entirely of ordinary paper, it will lose strength when wetted, and may tear apart during its initial use. If fabricated of just a thin film of synthetic polymer, the curtain will fail to drape properly due to either accumulation of static electricity on the film, or deflection by a stream of water or associated air currents. Thin films also lack opacity unless specially treated, or unless fabricated from costly materials.

Because the curtain is supported at its upper edge in a manner to permit horizontal traversal along a rigid track or rod structure, the construction of said upper edge is important. Curtains fabricated of thin paper or film would tear at the upper edge or deform under tension, thereby impeding drawing along the track. Although curtains which can be disposed of are more convenient to use than durable curtains which are cleaned and re-used, disposable curtains must be removed from the overhead track and subsequently replaced thereon with a new curtain. Unless the method of installing and removing a disposable curtain is simple, it could entail as much inconvenience as the cleaning of more costly, durable curtains. Most shower curtain installations utilize hooks which slidably engage the overhead track and also attach to the upper edge of the curtain through holes therein. The mounting of a curtain into said hooks, and its removal therefrom can be a tedious operation. This is particularly true in hotels, hospitals and other multi-roomed buildings containing a large number of shower installations. The holes in the top edge of the curtain may also cause sufficient stress to accumulate at an inserted hanger hook to initiate a tear.

It is accordingly an object of the present invention to provide an inexpensive flexible opaque shower curtain resistant to water on at least one side and capable of facile mounting onto a horizontal overhead track for traversing engagement therewith.

It is another object of this invention to provide an inexpensive flexible opaque shower curtain resistant to water on at least one side and capable of being packaged for shipment and storage in a compactly folded state from which said curtain may be deployed for use.

It is a still further object of the present invention to provide a shower curtain assembly comprising an inexpensive opaque curtain and means for easily attaching the upper edge of said curtain to an overhead support. These objects and other objects and advantages of the invention will be apparent from the following description.

SUMMARY OF THE INVENTION

The objects of the present invention are accomplished in general by providing as an article of manufacture a curtain ensemble comprising a flexible opaque rectangular sheet comprised of cellulosic paper, at least one surface of which is covered by an adherent layer of water-resistant organic polymer material, and a number of flexible strap members provided with contact-type adhesive means and adapted to function as support hangers which attach to the upper edge of said sheet and engage with an overhead support. One edge of said sheet, which may be considered the upper edge, is provided with a series of uniformly spaced holes. The sheet and strap members are formed into a compact flat package for shipment and storage.

BRIEF DESCRIPTION OF THE DRAWING

In the accompanying drawing forming a part of this specification and in which similar numerals of reference indicate corresponding parts in all the figures of the drawing.

DETAILED DESCRIPTION OF THE INVENTION

Figure 1:
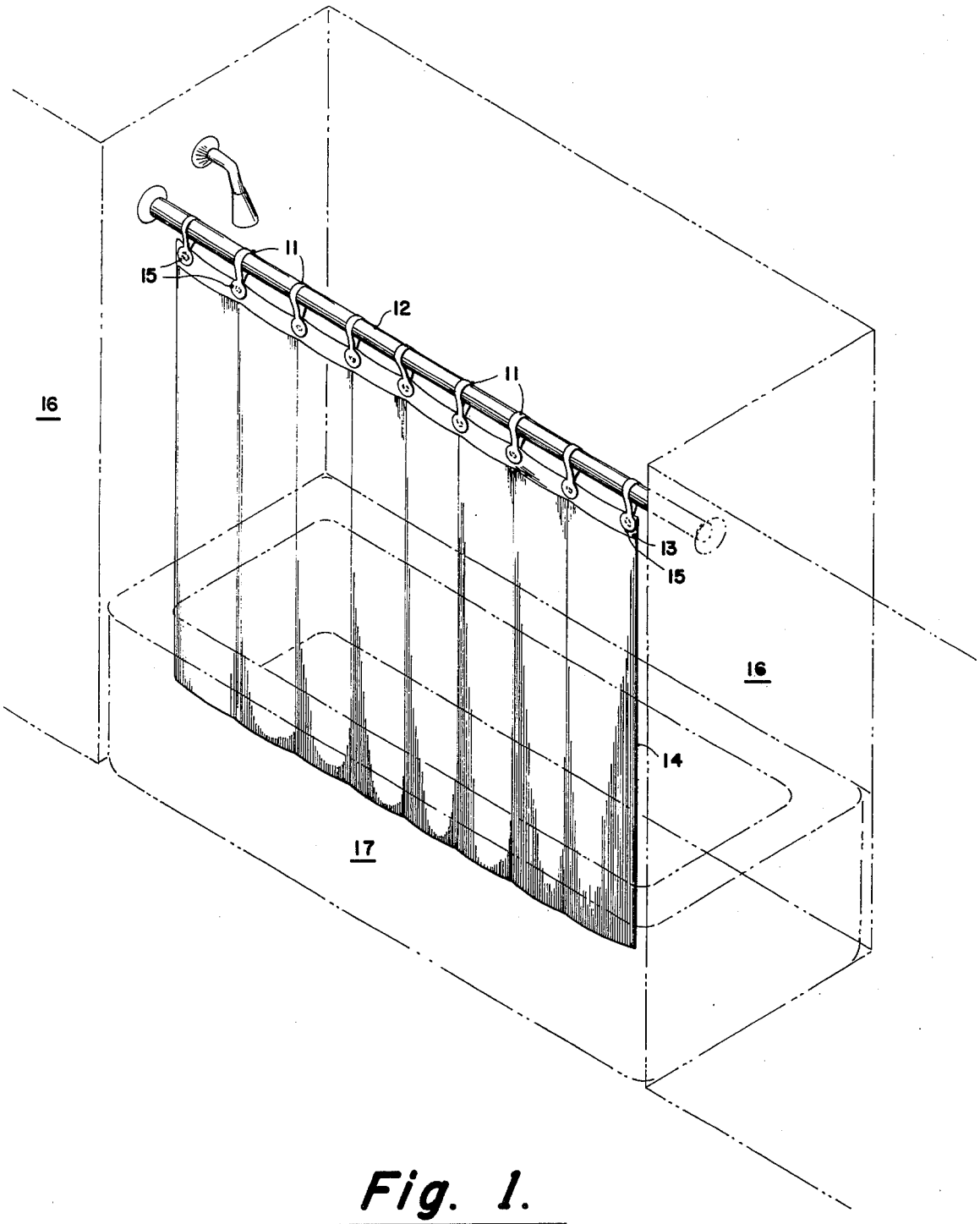
FIG. 1 is a perspective view of an embodiment of shower curtain ensemble of the present invention in the assembled and deployed state suspended from an overhead track.
Figure 3:
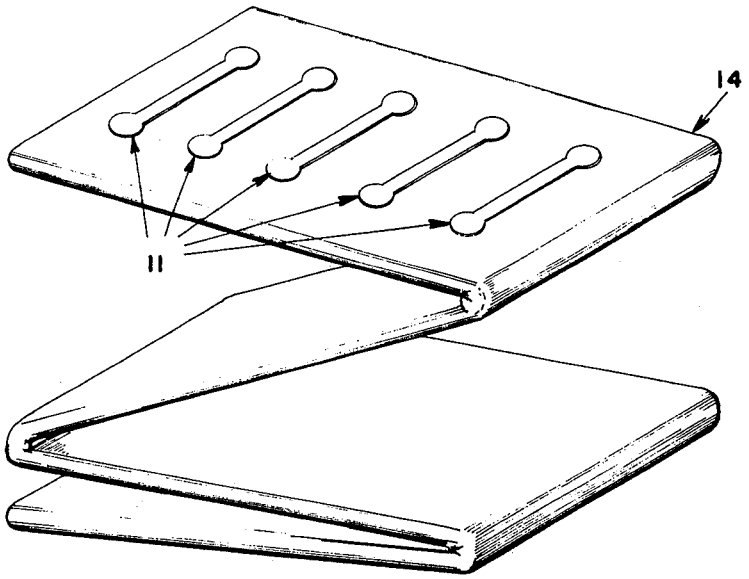
FIG. 3 is a perspective view of a shower curtain ensemble of this invention in the form of a shipping package, shown in partially opened form.

Referring to FIG. 1, an assembled shower curtain ensemble 10 of this invention is suspended by strap members 11 from overhead track 12 extending between walls 16 facing bathtub 17. Each strap member 11 is adhesively attached to the upper edge 13 of curtain 14 at spaced sites characterized in having apertures 15.

Figure 2:
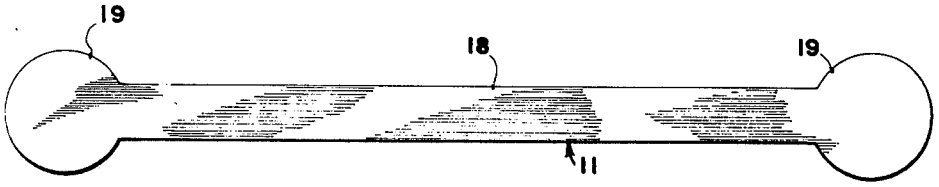
FIG. 2 is an enlarged plan view of a strap member utilized in the embodiment of FIG. 1.

As shown in FIG. 2, each strap member consists of a saddle portion 18 and anchor ends 19. Each anchor end is provided at least in part with an adhesive coating capable of bonding upon contact with other surfaces. The adhesive coating, of the contact-bonding type and generally formulated from a polybutene polymer, is protected during storage prior to use by association with a surface having low affinity for said adhesive coating and which will release the portion of said anchors having said coating without adversely affecting the properties of said coating. The protection of the adhesive coating in this manner may be achieved by either using a separately removeable piece of releasible film, folding the adhesive onto other portions of the hanger having suitable surface properties, or adhering the strap member to portions of the curtain.

The curtain 14 has a front or outer surface intended to be directly outwardly from the shower enclosure, and a rear surface which is intended to face the interior of the shower enclosure and be in contact with water. The front surface is preferably comprised of paper having a basis weight of between 50 and 400 grams/square meter, and preferably between about 70 and 300 grams per square meter. Papers having basis weights below 50 lack the rigidity and strength necessary to provide an acceptable shower curtain. When the basis weight of the paper exceeds 400 grams/square meter, it has been found that the resultant curtain lacks acceptable draping characteristics. The paper is preferably made from wood pulp via a waterleaf process as generally practiced on a fourdriner machine. Papers made by dry methods involving binders may also be employed, as may be non-woven paper-like sheets comprising fibrous forms of organic polymer. The paper may be decorated for improved appearance by printing, embossing, and other known techniques. The curtain member will have a length and width in the range of 5 to 7 feet.

The rear surface of the curtain is provided with a water-impervious layer of polymeric material. The layer may consist of a continuous integral film, or a coating bonded to the rear side of the paper constituting the front surface of the curtain. In those instances where the water-impervious layer is an integral film, the curtain is substantially a laminated structure. Attachment of the film to the paper may be achieved either by adhesives or thermal softening of the film. In either case, pressure, as may be achieved with coacting rollers, may be utilized to bring both the paper and film substrates into more intimate contact for improved bonding.

Coating techniques which may be utilized to produce a water-impervious layer include the use of solutions or dispersions of polymers which deposit a continuous film upon removal of the solvent or dispersing media. The polymer-containing solution or dispersion may be applied to the paper by spraying, dipping, roll coating, calendering or other methods. Following application of the polymer material, drying and/or curing may be achieved by uniform application of heat.

The water-impervious layer, particularly in the film embodiment thereof, is preferably comprised of a polymer such as polyethylene or polyvinylchloride. Such polymers, when suitably formulated, have sufficient flexibility and strength to provide a supple curtain which can be folded and unfolded without ill effect. When the water-impervious layer is applied as a coating, a wider range of polymeric materials may be utilized, including for example, waxes, polyurethanes, styrene-butadiene copolymers, silicones, cellulosic derivatives, ethylene oxide adducts, and polymers of vinyl acetate. The polymeric material should in general possess a softening point above 70° C., and should be flexible, resistant to decomposition or dissolution in water, non-toxic, and relatively inexpensive.

The curtain member 14 of the shower curtain ensemble possesses the following attributes:

1. opacity
2. pleasing appearance
3. ability to drape in loose folds
4. adequate weight and stiffness to resist deflection by water and air
5. resistance to water on at least one side
6. sufficient strength to withstand handling while wet
7. no static build-up
8. ability to unfold from the sharp creases existing in the compacted shipping package.

Achievement of these attributes may be accomplished by suitable selection amongst the several afore-mentioned parameters involved in the fabrication of said curtain member. The avoidance of static build-up is a consequence of the use of a cellulosic paper substrate. The ability to drape in loose folds is imparted by proper selection of paper weight and stiffness characteristics in association with a reasonably soft type of polymer. The ability to unfold from sharp creases formed in the course of packaging is derived from the composite nature of the curtain member, particularly when the polymer employed is of high molecular weight.

The strap members may be fabricated from the same material of which the curtain member is comprised, or may be fabricated of a material possessing greater tensile and tear strengths. The overall length of the strap member may range from about 4 to 8 inches. The width of the saddle portion of the strap member may range from about ½ inch to 2 inches. The anchor portions may be fashioned as round or square appendages having areas ranging from about ½ to 3 square inches. Because of their relatively large area of engagement with the curtain member, there is no stress accumulation to initiate tears.

It should be noted that, in the embodiment shown in FIG. 1, the two adhesive surfaces are brought into opposed engagement with the upper edge of the curtain in a manner to occlude a hole in the top edge. The two adhesive-containing surfaces of the strap member thereby meet within the area of the hole to provide a strong adhesive bond. Although the strap member achieves adhesive bonding to both the front and rear surfaces of the curtain, the aforesaid bonding which is obtained within the area of the hole is much stronger, and represents an important feature of this invention.

The holes in the upper edge of the curtain therefore serve three purposes: (a) to provide the user with the option of utilizing existing curtain hooks, (b) to mark the location for uniform attachment of a hook or strap member, and (c) to permit direct adhesive-adhesive bonding of the strap members. The region of the curtain member surrounding each hole is preferably reinforced to minimize the likelihood that the hole will initiate a tear. In a particularly preferred embodiment, the entire upper edge of the curtain is provided with a reinforced strip wherein the holes are located. One manner of reinforcement is preferably to duplicate on the front surface of the water-impervious layer of the rear surface of the curtain. The bottom edge of the curtain member may be weighted or provided with attachment means for stabilization of the lower portion of the curtain.

In order to enhance the economics of manufacture and use, the curtain ensemble of this invention is preferably packaged in a folded, compacted form. It is preferred that the mode of folding be such that vertical folds are first formed, which simulate pleat-type undulations in the curtain, followed by folding horizontally to form a flat rectangular configuration. The necessary strap members are packaged along with the folded curtain member. Upon deployment for actual use, the creases formed by the horizontal folding open up to present a more pleasing appearance of the curtain.

While particular examples of the present invention have been shown and described, it is apparent that changes and modifications may be made herein without departing from the invention in its broadest aspects. The aim of the appended claims, therefore, is to cover all such changes and modifications as fall within the true spirit and scope of the invention.

Having thus described my invention, what is claimed is:

1. A shower curtain assembly consisting of a flexible opaque rectangular sheet comprised of a cellulosic paper having a basis weight between 50 and 400 grams per square meter, at least one surface of said paper being covered by an adherent layer of water-resistant organic polymer material, said sheet containing adjacent its upper edge a uniformly spaced series of holes, and flexible strap members having an elongated configuration terminating in anchor ends having an area of between ½ to 3 square inches attached by contact-type adhesive to opposed sides of said sheet in a manner occluding a hole and providing direct adhesive bonding across the area of said hole, each of said strap members thereby forming a closed loop disposed above said upper edge, and adapted to engage an overhead support rod, said sheet having been deployed from a compactly folded state having initially formed folds in the vertical direction representing pleated folds, and subsequently formed folds in the horizontal direction.

* * * * *